US005501252A

United States Patent [19]

Bartzick et al.

[11] Patent Number: 5,501,252

[45] Date of Patent: Mar. 26, 1996

[54] FASTENER

[75] Inventors: Gerd Bartzick, Gevelsberg; Gerd Bühne, Schwelm, both of Germany

[73] Assignee: Fried. Krupp AG Hoesch-Krupp, Essen, Germany

[21] Appl. No.: 231,130

[22] Filed: Apr. 22, 1994

[30] Foreign Application Priority Data

Apr. 26, 1993 [DE] Germany ..... 43 13 641.9

[51] Int. Cl.[6] ..... B21F 9/02

[52] U.S. Cl. ..... 140/152; 140/93.2

[58] Field of Search ..... 140/93 R, 93.2, 140/93.4, 123.5, 123.6, 150, 152

[56] References Cited

U.S. PATENT DOCUMENTS 2,549,626 4/1951 Mosey ..... 140/93.2

3,319,666 5/1967 Langford et al. ..... 140/152

3,804,001 4/1974 Longerich et al. ..... 140/93.2

FOREIGN PATENT DOCUMENTS 597860 2/1948 United Kingdom ..... 140/152

*Primary Examiner*—Lowell A. Larson

*Attorney, Agent, or Firm*—Max Fogiel

[57] ABSTRACT

Fastener for fastening together the ends of a length of steel strap wrapped around a package in a package strapper. It has a top and bottom. The top is above the section of a track where the fastening is established. The bottom is below the same section. The top is accommodated in a housing that pivots on the bottom on a hinge paralleling the track. The top comprises strap-shaping punches, a strap clamp, and a strap cutter. The bottom comprises a strap-shaping die mounted on a base and facing the punches. The pivot simultaneously constitutes a rotating shaft that drives all the fastener's moving parts by way of cams, eccentrics, or levers and rods.

13 Claims, 2 Drawing Sheets

FASTENER

BACKGROUND OF THE INVENTION

The present invention concerns a fastener for fastening together the ends of a length of steel strap wrapped around a package in a package strapper. It has a top and a bottom. The top is above the section of a track where the fastening is established. The bottom is below the same section. The top is accommodated in a housing that pivots on the bottom on a hinge paralleling the track. The top comprises strap-shaping punches, a strap clamp, and a strap cutter. The bottom comprises a strap-shaping die mounted on a base and facing the punches.

The base in conventional package strappers is between the fastening and the package. It must accordingly be extracted to one side in order to release the package for removal. Extracting and re-inserting just the base renders the incision less precise due to wear and tear on the guides or dirt on the strap stops. The imprecision enlarges the nip between the punches and the die, which rapidly wears the punches out. This drawback is eliminated in known designs by mounting the strap punches and the die on a part of the housing that can be pivoted away from the track such that the punches and die remain in the same relative position even while the housing is being pivoted away.

One drawback to positioning the punches and die on the same pivoting housing is that it complicates the mechanism driving the punches in the strap clamping-and-cutting mechanism, which must be divided or separated while pivoting.

SUMMARY OF THE INVENTION

The object of the present invention is accordingly to simplify the mechanisms that drive strap-shaping punches and a strap-shaping die mounted on the same pivoting housing while retaining the advantage of the nip between them.

This object is attained in accordance with the invention in that the pivot simultaneously constitutes a rotating shaft that drives-the overall fastener. The out-and-back displacements of the punches, clamp, and cutter are generated by cams, eccentrics, or levers mounted on the shaft. Rods attached to eccentrics mounted on the shaft represent a particularly simple approach.

The components can be actuated in a required sequence if the eccentrics are distributed at different angles around the shaft.

BRIEF DESCRIPTION OF THE DRAWINGS

One embodiment of the present invention will now be specified by way of example with reference to the drawing, wherein.

DESCRIPTION OF THE PREFERRED EMBODIMENTS

Figure 1:
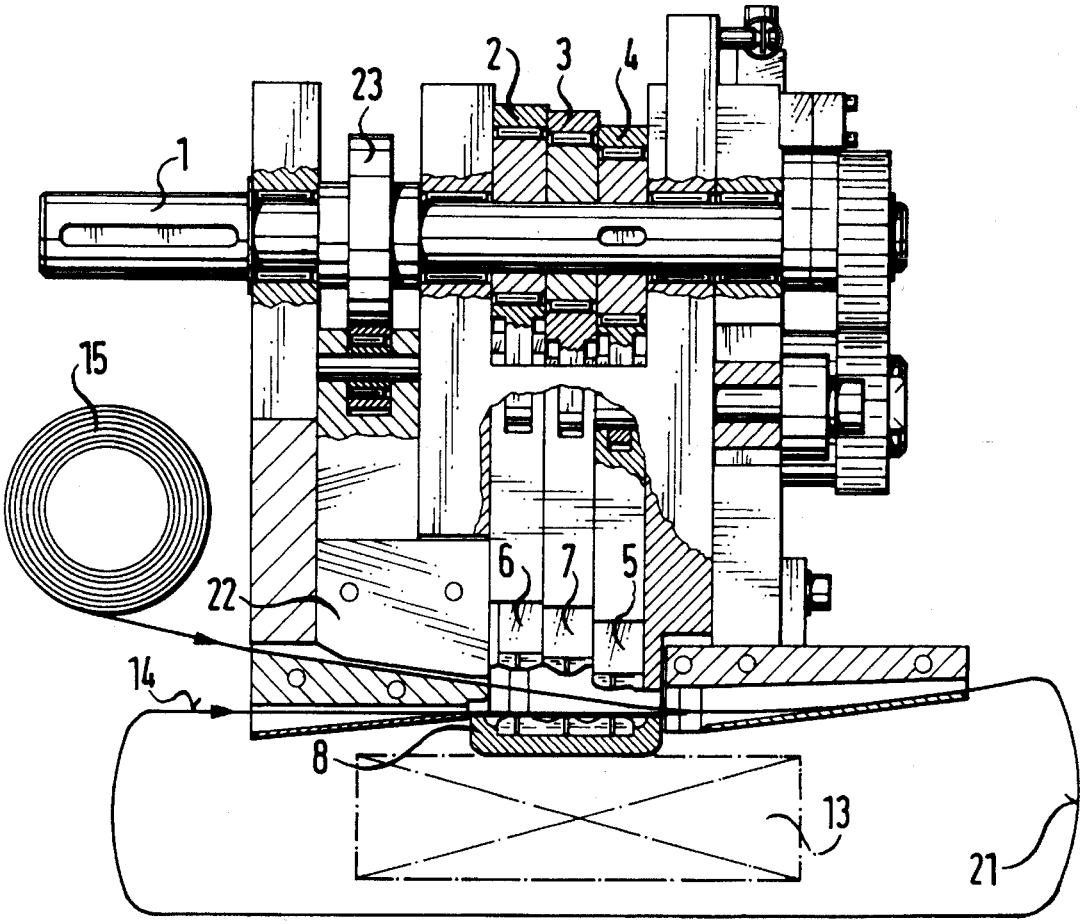
FIG. 1 illustrates a fastener driven by a shaft, FIG. 2 the stationary and pivoting components of the housing with its eccentrics, rods, punches and die together, FIG. 3 the components illustrated in FIG. 2 apart, and FIG. 4 the mechanism that pivots the housing.
Figure 2:
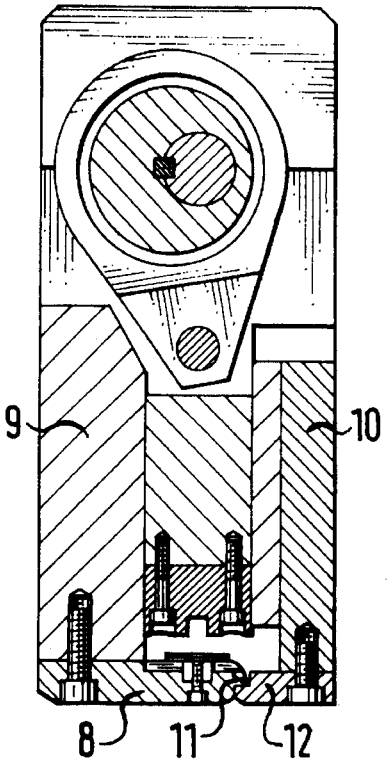
Figure 3:
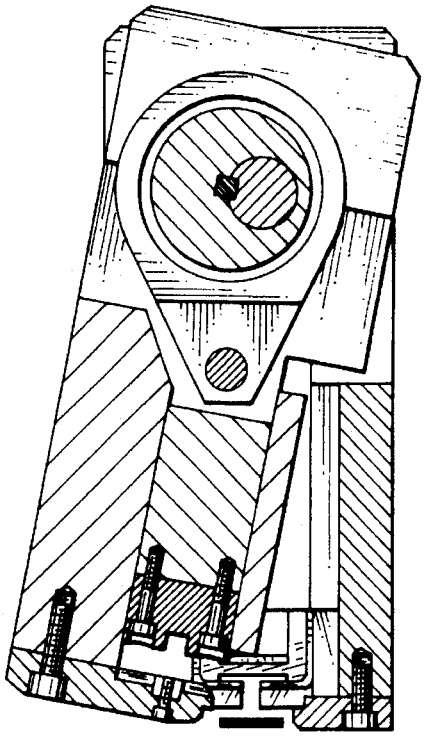

Eccentrics 2, 3, and 4 are mounted on a shaft 1 and actuate punches 5, 6, and 7 by way of rods. Below the punches is a base 8. Base 8 is secured to the pivoting section 9 of the housing. The stationary section 10 of the housing is represented on the right side of FIG. 2. With the overall assembly closed, a projection 11 on base 8 rests against a prolongation 12 on stationary section 10. The pivoting section 9 of the housing is represented pivoted out in FIG. 3. Base 8 is accordingly extracted from between package 13 and the finished fastening and the package can be removed and a new one introduced for strapping.

Punch 5 fulfills two functions. As the shaft rotates, the punch shapes a fastening out of strap 14. The punch also incorporates a strap-clamping edge that presses down on the stretched strap once the fastening has been created and establishes the tension on the strap. The tension on the section of strap between the stretcher and the fastener is then released and the section is severed by punch 6 from the section arriving from a supply reel 15. As punch 6 continues to descend it creates another fastening. Punch 6 accordingly also fulfills two functions, specifically severing the strap and creating a fastening. Punch 6 is now lifted, soon followed by punch 5, eliminating its clamping action. The two halves of each fastening now draw together subject to the resilience of package 13. If the package looses resilience, the fastening can come apart. Punch 7 prevents this by creating still another component of the fastening in the overlapping ends of the strap. This component cannot be separated.

Figure 4:
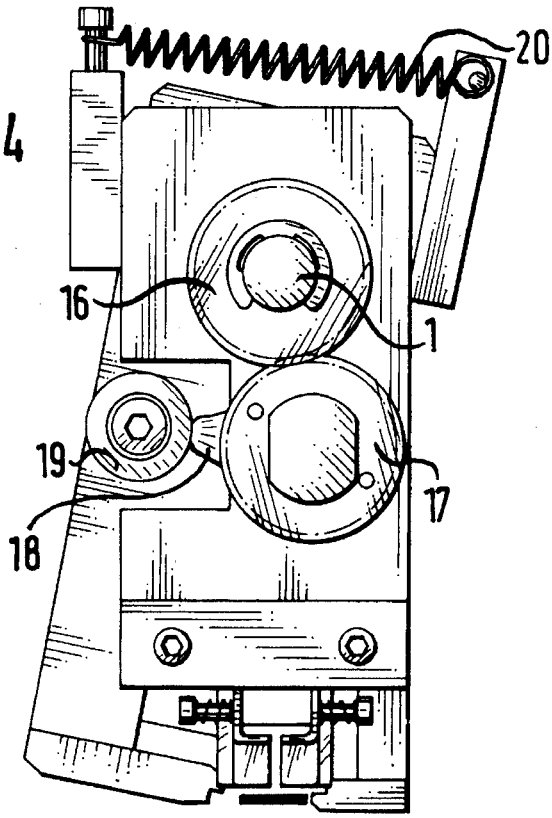

Punch 7 is now lifted like punches 5 and 6. As shaft 1 continues to turn, a cogwheel 16 mounted on it turns another cogwheel 17 associated with a cam 18. Cam 18 engages a roller 19 on the pivoting section 9 of the housing and pivots the housing out as illustrated in FIG. 4, releasing the strap against package 13. The package can now be removed. As shaft 1 continues to turn, cam 18 leaves roller 19, and a spring 20 pivots pivoting section 9 back in. Shaft 1 has now turned exactly one rotation, beginning with the beginning of the descent of punch 5 and ending with the pivoting in of section 9. The fastener is now ready for the next strapping.

The full rotation of shaft 1 required to create the fastening, however, is not continuous but interrupted by brief intervals. Interruption is necessary to allow the introduction of fresh strap 14 into strap track 21, represented by the line, to wrap around the next package 13. Shaft 1 is started by a signal from an unillustrated switch representing the arrival of leader, the forward end of the new strap, that is, in the ready-to-wrap position with strap track 21 entirely occupied by strap 14.

Shaft 1 continues to rotate slightly, 30° for example, and then stops. A cam 23 mounted on shaft 1 closes a clamp 22 during this slight rotation.

Strap 14, accordingly introduced and with its leader clamped by clamp 22, is now wrapped around package 13 in a known procedure by the retracting strap feed and by the strap stretcher. Shaft 1 does not start rotating again until the strap has been wrapped around the package. The shaft can be started for example when an unillustrated known switch mounted on the strap stretcher turns the strap-stretcher motor off in accordance with the level of tension in the strap and turns the shaft-rotation motor on. Shaft 1 now turns another approximately 50°, during which punch 5 shapes the first component of the fastening, and stops again. A clamp mounted on punch 5 clamps down on strap 14 just before the fastening component is created and maintains it clamped. The strap-stretcher motor is now allowed to briefly run in reverse. The section of strap between the clamp on punch 5 and supply reel 15 is accordingly relieved of all tension. It is this section that is now shaped and severed. Shaft 1 now continues to rotate, and a blade mounted on punch 6 severs strap 14 from supply reel 15 while the punch creates the second component of the fastening. Punches 5 and 6 are now lifted, allowing the fastenings below them to snap together due to the resilience of the strap 14 around package 13. Since the shape involves a specific known security conicity, the fastening cannot be disestablished by forcing it backwards. As shaft 1 continues to rotate, to approximately 270° from its initial position, the cam lifts clamp 22. The housing is pivoted out at approximately 310°, and the shaft stops rotating. The strapped package is now removed.

Shaft 1 now rotates to 360° and stops. The total procedure can now be repeated.

The permanent clamping cannot be achieved with an eccentric mechanism. The force is derived from a cam 23 mounted on shaft 1. Cam 23 acts directly on clamp 22 and secures it closed during the first approximately 240° of the shaft's rotation. The clamp 22 is retracted by an unillustrated spring.

The shaft can stop at angles other and indeed considerably other than those previously mentioned herein. All that is essential is that all the hereintofore discussed activities are completed during one complete rotation, so that a new package can be strapped during the next.

In one embodiment a clamp is provided on the side of the fastening-creating components where the strap arrives from the package enters the clamping position before the first fastening-creating component shapes the strap, and the strap stretcher relieves the tension in the strap by retracting it slightly immediately after it has been clamped or even before it has been shaped.

Furthermore, in another embodiment a clamp is provided on the side of the fastening-creating components where the strap arrives from the package enters the clamping position before the second fastening-creating component in the strap-processing sequence, and the strap stretcher relieves the tension in the strap by retracting it slightly immediately after it has been clamped or even before it has been shaped.

We claim:

1. A fastener for fastening together ends of a length of a steel strap wrapped around a package in a package strapping arrangement, comprising: a track section where said ends are fastened together; said fastener having a top above said track section, said fastener having a bottom below said track section; a pivot parallel with said track section; a housing for holding said top and pivoting on said pivot; said top comprising strap-shaping punches, a strap clamp, and a strap cutter; said bottom comprising a strap-shaping die mounted on a base and facing said punches, said punches and said die having a nip therebetween, said pivot comprising simultaneously a single rotating shaft with driving elements for driving said fastener, said driving elements on said rotating shaft displacing said punches, said clamp, and said cutter and retaining said nip between said punches and said die.

2. A fastener as defined in claim 1, wherein said driving elements comprise cams and rods mounted on said shaft for displacing straight forward and back said punches, strap clamp, and said strap cutter.

3. A fastener as defined in claim 2, wherein said punches, strap clamp, and strap cutter are articulated to said cams and rods during displacements.

4. A fastener as defined in claim 1, wherein said driving elements comprise eccentrics and rods mounted on said shaft for displacing straight forward and back said punches, strap clamp, and said strap cutter.

5. A fastener as defined in claim 4, wherein said punches, strap clamp, and strap cutter are articulated to said eccentrics and rods during displacements.

6. A fastener as defined in claim 1, wherein said driving elements comprise levers and rods mounted on said shaft for displacing straight forward and back said punches, strap clamp, and said strap cutter.

7. A fastener as defined in claim 6, wherein said punches, strap clamp, and strap cutter are articulated to said levers and rods during displacements.

8. A fastener as defined in claim 1, wherein said driving elements are distributed around said shaft at different angles and displace fully forward and back said punches, strap clamp and said cutter during one rotation of said shaft, said strap clamp being mounted on one of said driving elements.

9. A fastener as defined in claim 1, including a first gear mounted on said shaft; a second gear having at least substantially the size as said first gear and mounted below said shaft and engaging said first gear; a cam secured to said second gear and forcing a pivoting section of said housing forward against action of a spring for opening said housing and holding said housing in an open position.

10. A fastener as defined in claim 1, wherein said die is mounted on a pivoting section of said base, said die having an area substantially equal to the area of a bottom of said punches.

11. A fastener as defined in claim 1, including a strap stretcher; and a clamp at a location where the strap arrives from the package entering a clamping position before shaping said strap and before said strap stretcher relieves in the strap by retracting said strap substantially immediately after clamping said strap.

12. A fastener as defined in claim 1, including a strap stretcher; and a clamp on a side of first fastening means where the strap arrives from the package entering a clamping position before second fastening means in strap-processing sequence and said stretcher relieves tension in said strap by retracting said strap substantially immediately after clamping said strap.

13. A fastener for fastening together ends of a length of a steel strap wrapped around a package in a package strapping arrangement, comprising: a track section where said ends are fastened together; said fastener having a top above said track section, said fastener having a bottom below said track section; a pivot parallel with said track section; a housing for holding said top and pivoting on said pivot; said top comprising strap-shaping punches, a strap clamp, and a strap cutter; said bottom comprising a strap-shaping die mounted on a base and facing said punches, said punches and said die having a nip therebetween, said pivot comprising simultaneously a single rotating shaft with driving elements for driving said fastener, said driving elements on said rotating shaft displacing said punches, said clamp, and said cutter and retaining said nip between said punches and said die; said driving elements comprising cams and rods mounted on said shaft for displacing straight forward and back said punches, strap clamp, and said strap cutter; said punches, strap clamp, and strap cutter being articulated to said cams and rods during displacements; said driving elements being distributed around said shaft at different angles and displacing fully forward and back said punches, strap clamp and said cutter during one rotation of said shaft, said strap clamp being mounted on one of said driving elements; a first gear mounted on said shaft; a second gear having at least substantially the size as said first gear and mounted below said shaft and engaging said first gear; a cam secured to said second gear and forcing a pivoting section of said housing forward against action of a spring for opening said housing and holding said housing in an open position; said die being mounted on a pivoting section of said base, said die having an area substantially equal to the area of a bottom of said punches.

* * * * *